United States Patent [19]

Milligan

[11] 4,256,414

[45] Mar. 17, 1981

[54] ASPHALTIC CONCRETE RECYCLING APPARATUSES, PROCESS AND SYSTEM

[76] Inventor: James L. Milligan, 5001 Camp La., Amarillo, Tex. 79110

[21] Appl. No.: 6,275

[22] Filed: Jan. 25, 1979

[51] Int. Cl.[3] ..... E01C 23/14

[52] U.S. Cl. ..... 404/79; 404/92; 404/95; 366/1; 366/25; 126/343.5 A

[58] Field of Search ..... 404/79, 77, 72, 80, 404/91, 92, 95; 427/138; 366/61, 64, 1, 25; 126/343.5 A

[56] References Cited

U.S. PATENT DOCUMENTS

| | | | |
|---|---|---|---|
| 1,205,948 | 11/1916 | Popiless | 404/91 |
| 1,926,523 | 9/1933 | Fulton et al. | 260/28.5 |
| 1,938,755 | 12/1933 | Swearingen | 404/91 |
| 1,979,251 | 11/1934 | Chapline | 404/80 |
| 2,211,263 | 8/1940 | Flynn | 404/91 |
| 2,572,068 | 10/1951 | Sommer | 404/79 |
| 2,639,651 | 5/1953 | Scott | 427/139 |
| 3,162,101 | 12/1964 | Rostler | 427/138 |
| 3,423,222 | 1/1969 | McConnaughay | 366/64 X |
| 3,510,073 | 5/1970 | Mailliard | 404/91 X |
| 3,843,274 | 10/1974 | Gutman | 404/91 |
| 3,845,941 | 11/1974 | Mendenhall | 366/24 |
| 4,011,023 | 3/1977 | Cutler | 404/91 |

*Primary Examiner*—Nile C. Byers, Jr.
*Attorney, Agent, or Firm*—Ely Silverman

[57] ABSTRACT

Weathered asphaltic concrete road surface material is mined at each of a series of road locations and heated at or near the site of mining and future laydown to form particulate agglomerates of aggregate and asphalt in a form receptive to asphalt rejuvenation additives, mixed with such asphalt additives and passed to a laydown apparatus and returned to a road location near or at that location from which the weathered asphaltic concrete was initially taken. The steps of mining, rejuvenation and laydown and related storage and screening are simultaneous and continuous.

11 Claims, 14 Drawing Figures

ASPHALTIC CONCRETE RECYCLING APPARATUSES, PROCESS AND SYSTEM

BACKGROUND OF THE INVENTION

1. Field of Invention

The field of art to which this invention pertains is recycling asphalt aggregate compositions.

2. The Prior Art

Prior processing of recycling asphalt aggregate compositions, as in U.S. Pat. No. 3,845,941 required early feed grinding described at page 538 in "Recycling of Asphalt Concrete, description of Process and Test Sections" by Dunning, Mendenhall and Tischer, Asphalt Paving Technology 1975, Proceedings of Association of Asphalt Paving Technologists, Volume 44, pgs. 537–562, and energy-consuming apparatus therefor and tumbling of heavy feed particles and substantial transportation of feed and product; other systems as in U.S. Pat. No. 3,423,222 using direct exposure of asphalt to flame cause burning and deterioration of the asphalt as well as pollution hazards.

The apparatuses generally used in this art are described in "A History of Plants, Equipment and Methods in Bituminous Paving" by Tunnicliff, Beaty and Holt, Asphalt Paving Technology 1974, Proceedings of Association of Asphalt Paving Technologists, Volume 43 A, pgs. 159–296.

Chemical analyses of asphalt are described in U.S. Pat. Nos. 1,926,523 and 3,162,101 as resulting to rejuvenation additives therefor.

SUMMARY OF THE INVENTION

In an asphalt pavement recycling system (as in FIGS. 2, 3, and 8–11) slabs of weathered asphalt concrete (as shown in FIG. 5) obtained from a roadbed section (as 61 in FIG. 8) are fed into the chamber of a furnace apparatus, 30. In the apparatus 30, heat is developed by combustion of gas (as by burners 55 and 56) sufficient to melt some asphaltic constituents of the asphaltic concrete in the feed to such chamber and is transferred to the asphaltic concrete by radiation in a chemically neutral atmosphere. The asphaltic concrete slabs are supported on a flat plate [34] and moved along the plate by each of a series of drag blades (as 45 on chains 46 and 47); there is no change in the particle size of the aggregates and no chemical alteration of the asphalt as only such heat is applied as to create change in the physical state of the asphaltic components thereof sufficient to form a friable flowable mass of particulate agglomerates of plastic asphalt and aggregate.

The friable product [58] of the furnace 30 has a angle of repose less than 25 degrees and is placed in a pug mill as 85 and there treated with a flux as in U.S. Pat. Nos. 2,639,651 or 3,162,101. The particles in product 58 are porous and provide for ready absorption of the additive as the temperature of heater 30 is high enough to provide for ready absorption of the additive material in the time provided by pug milling. The resultant asphaltic concrete is then passed to a conventional portable onsite distributing or laydown apparatus 86 and returned to the road section or location as 61 of treated road from which initially extracted or to a like road section.

This system, apparatus and process thus provide very substantial labor and energy savings as well as time saving effect in the operation of rejuvenating and recycling weathered asphalt road surface compositions.

BRIEF DESCRIPTION OF THE DRAWINGS

FIG. 8 is a first stage of removal and storage of asphalt concrete. FIG. 9 similarly shows a second stage of operation of system 25 wherein mining occurs in another zone 62 while laydown occurs in the first zone 61 concurrent with asphalt treatment by recycle treatment apparatus 20. FIG. 10 shows a third stage of operation of system 25 wherein mining occurs in a third zone 63 of the road 60 and laydown occurs in the zone 62 concurrent with operation of recycle treatment apparatus 20. FIG. 11 shows a subsequent stage of operation wherein mining occurs in a further zone 64 of road 60 while laydown occurs in the zone 63.

Figure 1:
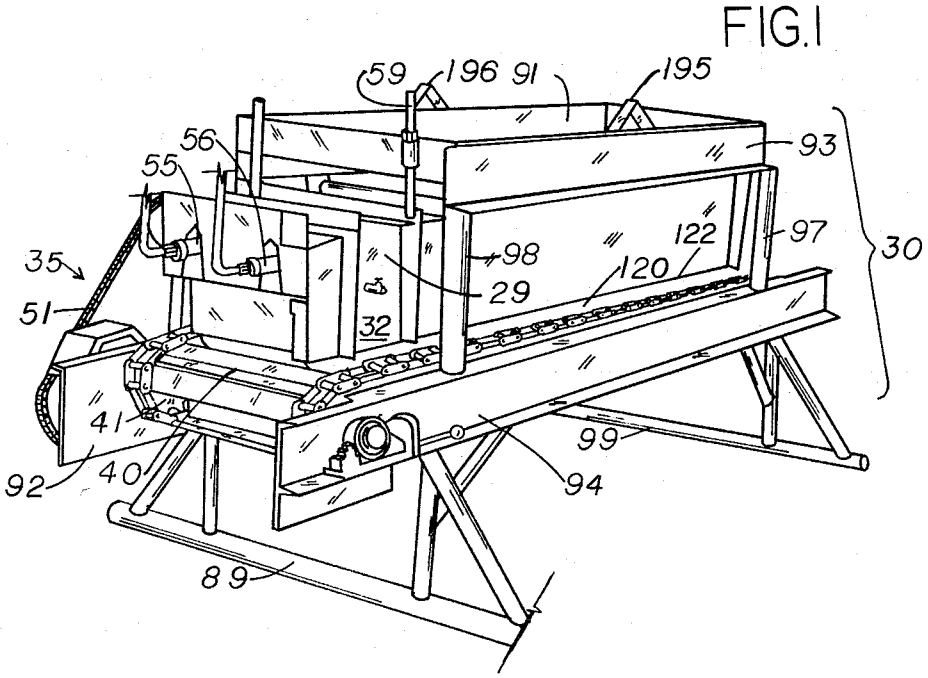
FIG. 1 is an oblique view of the furnace apparatus 30 as seen from left side and rear or discharge end.
Figure 2:
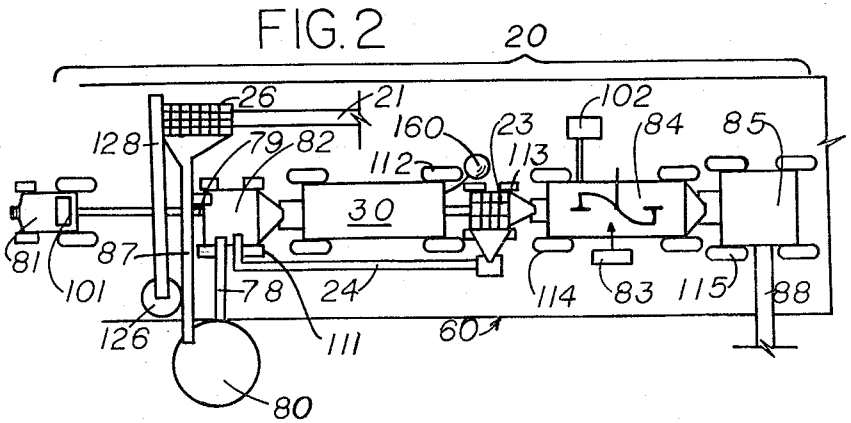
FIG. 2 is an overall diagrammatic plan view of the mobile asphalt concrete recycling apparatus 20 of this invention.
Figure 3:
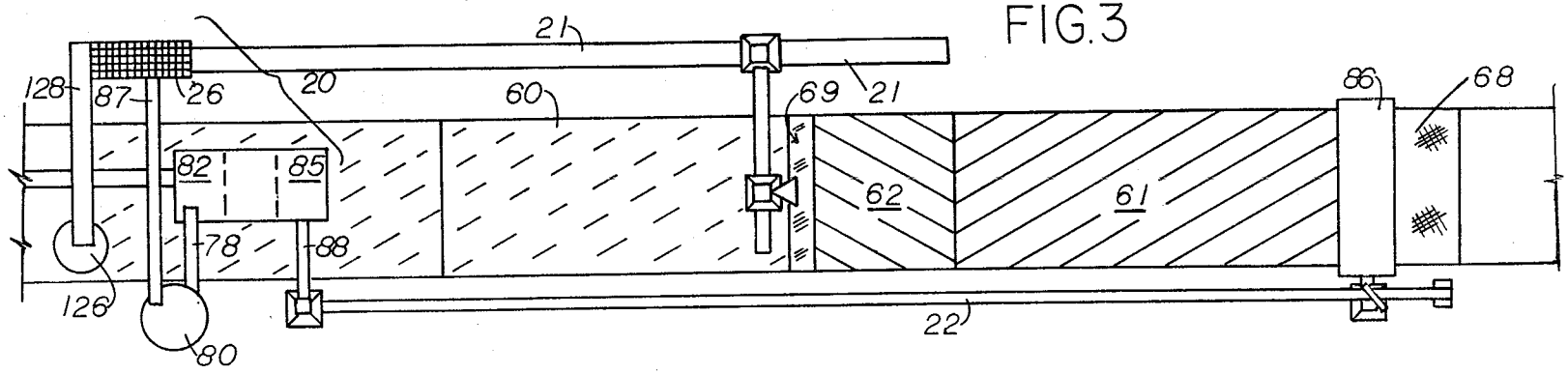
FIG. 3 is an overall plan diagrammatic view of system 25 of continuous asphalt concrete road rejuvenation, which system comprises apparatus 20 of FIG. 2.
Figure 4:
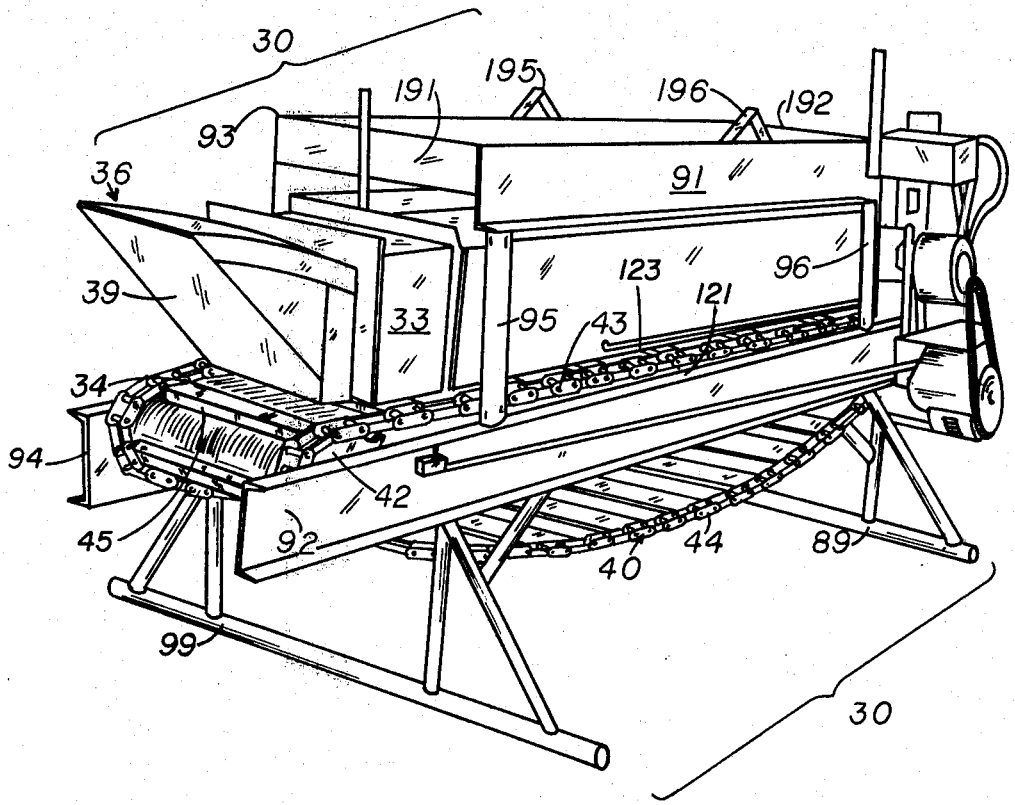
FIG. 4 is an oblique view of the furnace apparatus 30 as seen from its right side and front or feed end.

Right and left in this description refers to the right hand side of apparatus as seen from its feed end, i.e., right as shown by right hand side in FIG. 4.

DESCRIPTION OF THE PREFERRED EMBODIMENT

The asphalt pavement recycling system 25 comprises a recycle treatment apparatus 20, treatment apparatus feed and product conveyor units 21 and 22, a laydown apparatus 86 and a tractor 81. The system 25 operates on successive portions as 61–64 of a road 60 formed of asphalt concrete. System 25 is mobile.

The apparatus 20 comprises a bin 82, screen 23 oversize conveyor 24, heater assembly 30, reagent adder 83, pug mill 84, hot storage bin 85 and treatment apparatus input and discharge conveyors 87 and 88, and reserve pile conveyor 77.

The heater apparatus 30 comprises a heater frame 27, a chamber upper shell 29, a chamber lower shell 28, a feed support plate 34 and a conveyor assembly 40. The frame 27 comprises rigid longitudinally extending frame members 91–94, transversely extending members 191–194, vertically extending frame members 95–98 and feet 89 and 99. The elements 89–99 and 191–194 are firmly joined together and support the shells 28 and 29 and elements of conveyor assembly 40 and plate 34.

The upper shell 29 of the heater assembly 30 comprises a vertical left wall 32, a vertical right wall 33 and a horizontally extending roof 38. These are joined together to form a downwardly open U-shaped hood. A horizontal flat rigid plate 34 is firmly supported on lower transverse members as 193 of the frame 27 at the bottom of shell 29 and in the heater chamber 31, which chamber 31 is within the wall 32, 33 and 38.

A conveyor assembly 40 extends from beyond discharge end 35 of the chamber 31 past feed end 36 thereof to below a feed hopper 39 which feed hopper passes the feed material 49 onto the plate 34. Conveyor assembly 40 comprises a front or discharge gear wheel 41 and a feed or rear gear wheel 42. An upper chain flight 33 and a lower chain flight 34 each carry blades as 45 on left and right conveyor chains as 46 and 47. A motor 50 supported on frame 27 operates through a drive chain 51 upon a driven gear 52 and a gear box 53 also supported on frame 27, to drive the front or discharge gear wheel 41 and conveyor chains 46 and 47 of the heater conveyor assembly 40.

Figure 8:
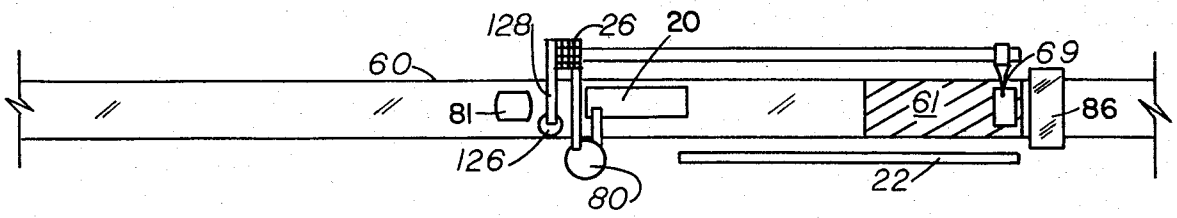
FIGS. 8–11 show diagrammatically in plan view stages in the operation of the system 25 of this invention.

In operation of the system 25 weathered asphalt concrete slabs are mined from a first road surface section as 61 by a mining apparatus 69 and passed by a treatment apparatus feed conveyor 21 and through screen 26 to a first feed storage or surge pile 80 or to an oversize pile 126, as shown in FIG. 8.

The feed material 49 to furnace or heater apparatus 30 comprises slabs 70–76 (FIG. 5) each slab being one and one-half inches thick (shown as 176) and six to twelve inches in width (shown as 175) and composed of aggregate particles as 170, 172, and 174 and asphaltic cement therebetween and firmly adherent thereto. Wider slabs can be used for a larger heater apparatus than the one (30) below discussed. However, the relation of the screening apparatus as 26 to the heater apparatuses below described (to screen out slabs too large for treatment by the heater apparatus following the screen) is the same regardless of slab size.

Figure 5:
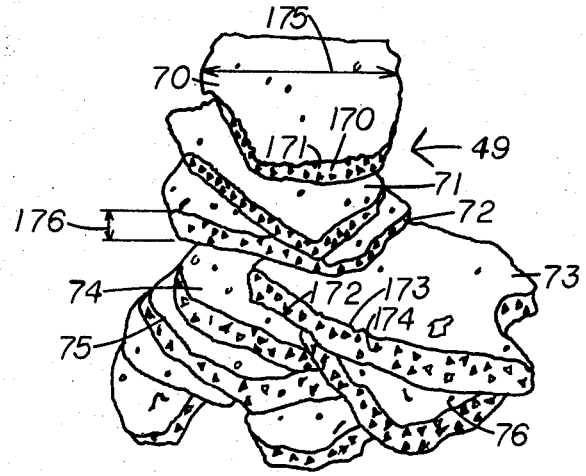
FIG. 5 is a pictorial and scale drawing of the feed to the apparatus shown in FIG. 4.

FIG. 5 is an oblique view taken at 45 degrees to the upper weathered surface substantially flat surface of slab 70, across which the width 175 is indicated; the flat surfaces of the other slabs 71–76 are substantially parallel to the upper substantially flat surface of slab 70. FIG. 5 shows the irregular peripheral outline and flat upper surface of such slabs and the transverse end view of such asphaltic concrete slabs is shown to illustrate they are composed of aggregate (of which the larger particles are shown as 170, 172, 174) and solidified asphalt (171, 173) therebetween.

The operation of system 25 becomes a continuous operation after the mining the initial road surface portion 61. Such portion 61 is of a length such that the laydown apparatus 86 can handle the later covering thereof while the weathered surface layer of asphaltic concrete initially on a second portion of road as 62 is mined. The oversize of the slabs that fail to pass through the screen 26 passes by an oversize slab conveyor belt 128 to the initial oversize feed pile 126. The undersize of screen 26 passes by feed belt conveyor 87 to initial feed surge pile 80 and therefrom to feed bin 82 by feed bin conveyor 78. Such first stage of operation is shown in FIG. 8.

Figure 9:
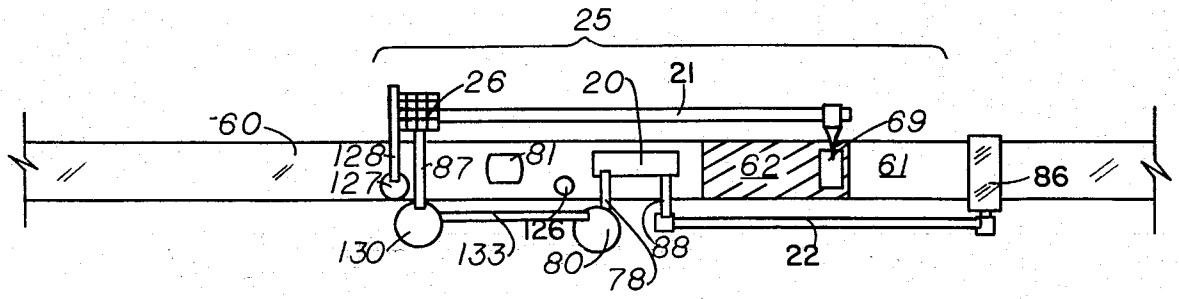

Thereafter, as shown in FIG. 9 weathered asphalt concrete is lifted up from the surface of a road section as 62 adjacent to 61 by the mining apparatus 69 and passed to feed conveyor 21 and passed by that treatment assembly feed conveyor 21 either to and through screen 26 to a second feed surge pile 130 neighboring to a planned subsequent position (as shown in FIG. 9) of the mobile recycle treatment apparatus 20 while the material in surge pile 80 is passed to treatment apparatus 20 by the treatment apparatus input conveyor 87; concurrently a second oversize slab pile 130 is formed by passing the oversize slab from screen 26 via mobile conveyor 128 to such pile 130.

The tractor 81 is provided with an electrical generating unit 101 which provides electric power to the motors for all system conveyors (e.g. 21, 22, 24, 78), motors for screens as 23 and 26, motor 102 for pug mill 84 and motor 50 for heater apparatus conveyor 40 during operations as shown in FIGS. 8–11. After completion of each stage of operation as shown in each of FIGS. 8, 9 and 10 the tractor 81 serves to draw the components of mobile treatment apparatus 20 to the subsequent operating position thereof as in FIGS. 9, 10 and 11 respectively. Generator 101 is operatively connected to such motors of system 25.

The overall cycle of operating the system 25 comprises the sequence of steps of first mining asphalt concrete slabs by a mining machine 69 from a road portion as 61 for later rejuvenation of the thus mined asphaltic component of the concrete (e.g., from portion 61) and still later laydown of the asphaltic concrete mixture of rejuvenated asphalt and aggregate. An initial feed surge pile as 80 and first oversize feed pile 126 are also produced during that first period of operation as shown in FIG. 8.

The slabs of such surge pile 80 are fed to the bin 82 and heater assembly 30 during the initial stage of FIG. 8 and during the second stage of operation as shown in FIG. 9. During the second stage of operation shown in FIG. 9 slabs from feed surge pile 80 are fed to feed bin 82 and are fed therefrom to the heater assembly 30 with concurrent steps of stripping surface asphaltic concrete material from road portion 62 and rejuvenation of material earlier mined from road portion 61 and laydown of rejuvenated material on zone 61 as in FIG. 9 while, also concurrently, the second feed surge pile 130 and second oversize pile 127 are formed.

Figure 10:
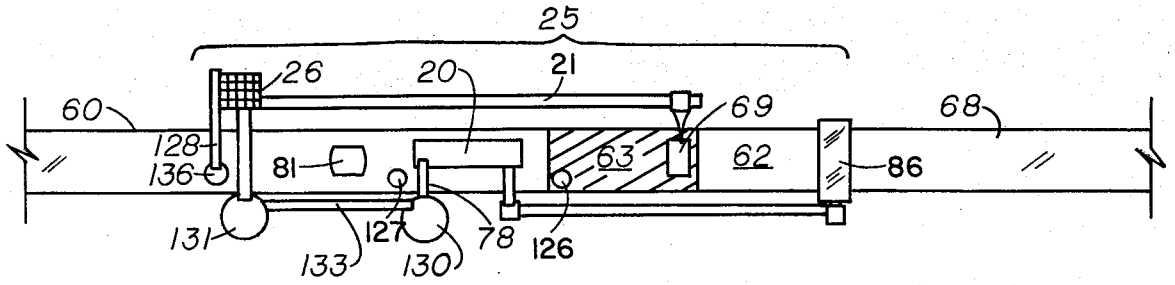

During the third period of operation as shown in FIG. 10 the slabs of the second feed surge pile 130 are fed to the bin 82 and therefrom to heater assembly 30; during that third stage of operation, as shown in FIG. 10 concurrent steps of stripping asphaltic concrete from zone 63 and rejuvenation of material from zone 62 and laydown on formerly stripped zone 62 occur while, also concurrently, the third feed surge pile 131 and third oversize pile 136 are formed.

Figure 11:
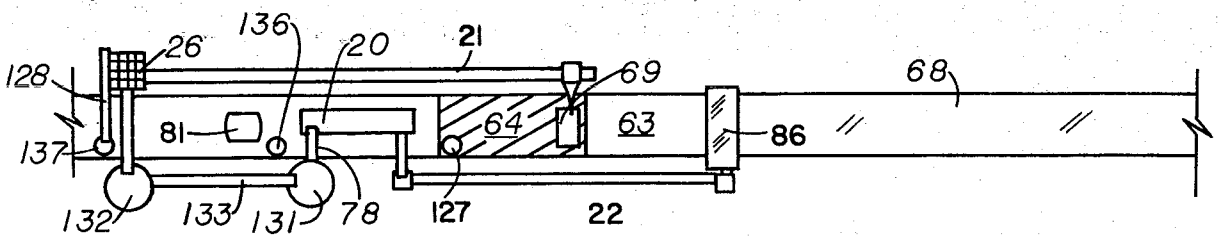

During the fourth period of operation as shown in FIG. 11, the third feed surge pile 131 is fed to the feed bin 82 and, therefrom to heater assembly 30. During that fourth stage of operation, as shown in FIG. 11 concurrent steps of stripping of asphaltic cement from road portion 64 and rejuvenation of material from road portion or zone 63 and laydown thereof on formerly stripped zone 63 occur while, also concurrently, the fourth feed surge pile 132 and oversize pile 137 are formed.

A mobile equalizing conveyor 133 extends from each later-formed feed surge pile as 130 (or 132), during its formation to an immediately earlier formed feed surge pile as 80 (or 131, respectively) from which earlier formed pile material is passed by bin feed conveyor 78 to the mobile feed bin 82 so that the feed to bin 82 may be maintained at a steady rate notwithstanding variations in earlier mining rates and size of the earlier formed surge pile and demands by the laydown apparatus 86. Each earlier formed surge pile as 80 or 131 also may be transferred to the later formed surge pile (as 130 or 132) to accommodate to variations in laydown rate by apparatus 86.

The treatment apparatus input conveyor 78 feeds into a mobile feeder bin 82 which bin is attached to and drawn by the tractor 81. Such bin 82 discharges to and is firmly attached to the feed end of the heater apparatus 30 and feeds slabs as 70–76 into the feed hopper 39 of apparatus 30. A heater apparatus discharge screen 23 is operatively attached to the discharge end of the heater apparatus 30. A pug mill 84 is attached to and drawn behind the heater assembly 30 and the screen 23 and is arranged to receive the undersize of the discharge screen 23. The oversize of the discharge screen 23 is returned to the bin 82 by a conveyor 24. The pug mill 84 is attached to and supports a reagent feeder 83. The discharge of the pug mill empties into a hot storage tank 85. This storage tank 85 discharges by a discharge conveyor 88 to the treatment assembly product conveyor 22. The conveyor 22 feeds a laydown apparatus 86 which operates to cover the previously mined area (61 in FIG. 9) with the material provided by the assembly 20.

Accordingly, in continuous operation as in FIGS. 9–11 of the system 25, successive portions of the road as 61, 62 and 63 are broken up or mined—portion 61 being broken up in FIG. 8, portion 62 being broken up as shown in FIG. 9 and portion 63 being broken up and mined as is shown in FIG. 10 and portion 64 broken up and mined as shown in FIG. 11. The material from the mined area is in the form of slabs as in FIG. 5 and is passed via the conveyor 21, bin 82, screen 26 into the hopper as 36 of the heater assembly 30. The material initially in the bin 82 is transformed by the heater assembly 30 to freely flowable particles of aggregate surrounded by asphalt cement. Such freely flowable particles are transferred to the pug mill 83 in which additive is added thereto. The pug milled mass of aggregate and asphalt cement is then stored in a conventional hot store apparatus as 85 and then conveyed therefrom by a conveyor as 22 to the conventional laydown machine. Such laydown machine places such rejuvenated asphalt on top of the base which remains after surface removal from a zone (as 61 as shown in FIG. 8) and such zone as (61 in FIG. 8) is surfaced by the rejuvenated asphalt cement and aggregate mixture as shown in FIG. 9. Similarly the mined mixture of weathered asphalt and aggregate from each of zones 62, 63 and 64 is passed similarly to the recycle treatment apparatus 20 and therefrom to the laydown machine 86 to be applied to the roadbed from which the weathered asphalt had earlier been removed.

To insure that properly sized material be fed to the heater apparatus 30, in view of the range of sizes of slabs mined from the surface of the separate sections of road as 61–64, so that the product of apparatus 30 may be sufficiently uniform to readily accept asphalt treatment chemicals and form particulate agglomerates of treated asphalt and aggregate useful in forming a new asphaltic concrete road surface, screens are provided for both the feed to and the discharge from heater assembly 30. The screen 26 and conveyor 128 remove the oversize materials and send such oversize materials to an oversize feed pile as 126 while the properly sized material is fed to the feed pile 80 and therefrom to apparatus 30. Such oversize material in the pile 126 awaits movement of system 25, as shown in FIGS. 9 and 10 until mined and broken with succeeding batches of asphaltic cement pavement; thus, the oversize pile 126 is treated with the mass of material mined from zone 63. The later formed pile of oversize material, 127, is treated with the material mined from zone 64, as shown in FIG. 11. Thereby weathered material from the road 60 is broken up to a size that will freely flow through the heater assembly 30.

The screen 23 at the heater assembly discharge end 35 provides for passage of its undersize particulate agglomerate material to the pug mill 64 and also provides for recycling of its oversize material via conveyor 24 back to the feed bin 82. Accordingly, the system 25 provides a process of treating weathered asphalt concrete located in a roadbed portion as 61–64 and comprising a mixture of asphaltic concrete (with aggregate) by;

(a) first removing the embrittled asphaltic concrete from its location on the roadbed in the form of dimensionally stable generally flat slabs of asphaltic concrete, as 71–76, each 1 inch to 3 inch thick and from 6 to 12 inches wide and 6 to 12 inches long as shown in FIG. 5; and thereafter (b) passing such slabs onto a support plate as 34 within the heater chamber 31 and moving such slab material through such chamber while heating it and thereby (c) raising the temperature of the mixture of asphalt and aggregate until the asphalt melts and thereby decomposes the initially dimensionally stable masses as 71–76 into a flowable mass of discrete particulate agglomerates as 58 with each agglomerate comprising a mass of aggregate with an asphaltic covering thereon, then incorporating asphalt rejuvenating material into such mass, and then (d) passing such rejuvenated mixture of asphalt and aggregate to a zone of the roadbed whereat such rejuvenated asphaltic concrete mix is applied to the roadbed.

Figure 6:
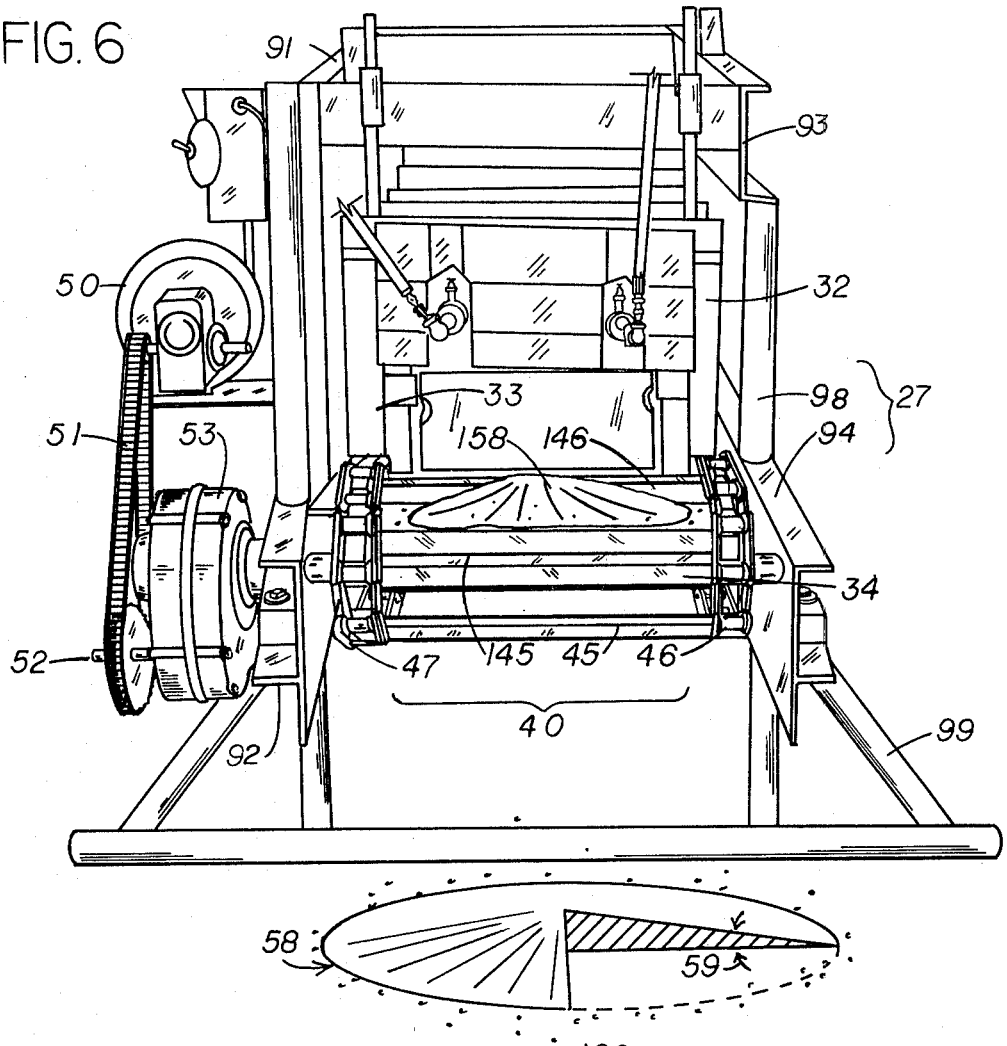
FIG. 6 is an elevation view of the discharge end of the apparatus 30 and shows also the discharge product 68 discharged from that apparatus 30.
Figure 7:
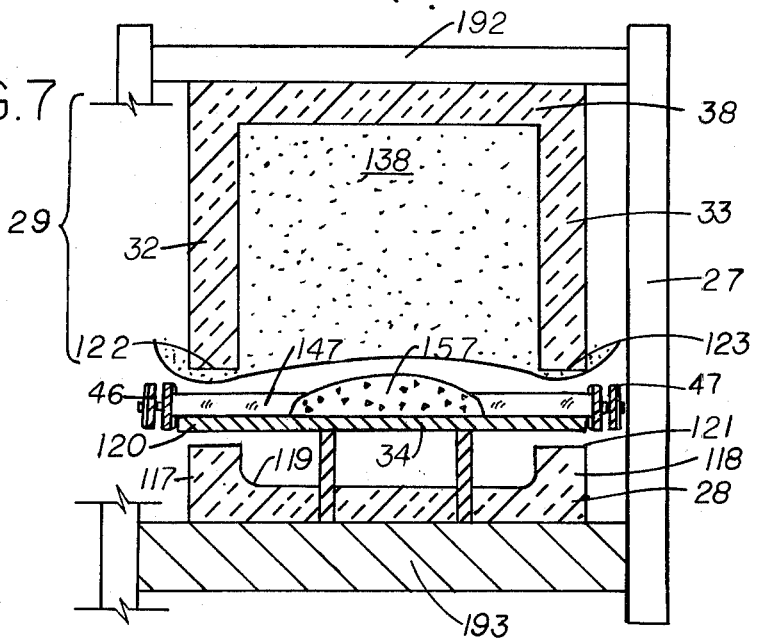
FIG. 7 is a vertical sectional view transverse to length of apparatus 30 viewed from feed end to discharge end.

Each slab as 71 becomes, as shown in FIG. 7, a fluent pile as 158 of particulate partially melted agglomerates located on the rigid flat feed support plate 34 and between two blades as 145 and 146 of the conveyor 40 prior to discharge from the plate 34 to form the flowable mass 58. The product 58 discharged from heater apparatus 30 in its usual form, as shown in FIG. 6 is generally conical or a spherical segment as shown in the vertical section in FIG. 7 passing through the center or axis of such generally conical or spherical segment shape: such section view illustrates the angle 59 of 15 to 20 degrees that is the usual angle of repose of such product 58. Such product is formed of agglomerates of average diameter of one-eighth inch and of usual maximum diameter of one-quarter inch and is a readily flowable particulate mass.

The conveyor 40, in operation, discharges successive increments of partially melted piles of such particulate agglomerates; i.e., each slab as 71 added to plate 34 as between blades 45 and 145 of conveyor 40 is discharged to the screen 23 and the undersize thereof passes to pug mill 84 and the oversize (over three-eighths inch) diameter is returned by conveyor 24 to bin 82. Each of the following increments, as 158 of material treated on plate 34 in chamber 31 is similarly discharged to screen 23.

The burners 55 and 56 are located at the rear or discharge end of the chamber 31 between the bottom of the roof 38 and above the level of the lower edges of the walls 32 and 33 and are located about two-thirds of the distance from the wall edges 122 and 123 to the bottom of the roof 38. The axes of the burners are parallel to each other and to the plane of roof 38 and to the planes of walls 32 and 33. The flame provided by each of the burners is not directed at the slabs or at the upper surface of the feed, but is directed to provide heat to the interior of the walls 32 and 33 and the bottom of the roof 38 so that heat from the flames produced by the burners will reach the to-be-treated masses of feed by radiation rather than by directly contacting the treated asphalt concrete mixtures. A source of butane or natural gas, 160, is operatively connected to the burners to feed such gas thereto.

Combustion of the fuel fed into the heater or furnace chamber 31 by the burners 55 and 56 provides a zone 138 of particularly hot chemically neutral gases adjacent the roof 38 of chamber 31. The gases so produced are neither oxidizing or reducing in chemical characteristic relative to the asphalt and, as diagrammatically shown in FIG. 7, pass out of chamber 31 through passageways provided by the horizontally extending and horizontally elongated slots or spaces 120 and 121 between the upper heated chamber shell 29 and the lower chamber shell 28. Such passageways or slots 120 and 121 extend vertically above the top of chains as 46 and 47 on which the plates as 147 (which plates are like plates 45, 145 and 146) are carried above and along and in contact with plate 34. The drag plates 45, 46, 145, 146, and 147 are rigid flat plates connected to and carried by conveyor link chains 46 and 47 and are of the same size and shape.

As the bottom edges 122 and 123 of heater walls 32 and 33 which walls form the top ends of slots 120 and 121 respectively are higher by one inch or more above the plate 34 than the upper edges of the conveyor drag plates and such upper edges are at substantially the same level as the top of treated slabs as 77 on the feed end of that plate 34, the flow rate of hot gases in a direction transverse to the length of plate 34 and transverse to the length of mass of fed material along the length of chamber 31 and in contact with such material is negligible. Accordingly there is no washing action of vaporizable constituents in the heated asphalt portion of the asphaltic concrete by this flow characteristic of the gas paths in chamber 31 although such slabs are heated by the combustion gases and hot walls in the chamber 31 until the asphaltic components of the feed melt and the slabs decompose to form particulate agglomerates of aggregate and melted asphalt.

The shape of the feed slabs as 70–76 changes from the flat dimensionally stable slabs of relatively uniform thickness (of one and one-half to two inches range, shown as 176 in FIG. 5 for the feed to the particular apparatus 30) and of irregular outline and length and width. As shown in FIG. 5, as 175, such width and length is in range of six to twelve inches at the feed end of apparatus 30. The product produced by apparatus 20 from such feed is a friable and flowable mass of particulate material as 58. The angle of repose of material on plate 34 changes while passing through the chamber 31 of heater apparatus 20: while the feed masses 71–76 are dimensionally stable weathered asphaltic concrete slabs with sharp yet stable edges, their shape changes to the curved dome-like shape of the upper most segment of an ovoid as 157 in FIG. 7 on passage through chamber 31 and then to the shape of the upper segment of a sphere at discharge, as shown at 158 and approaches a rounded or truncated cone as shown at 58 in FIG. 6.

In the particular embodiment of apparatus 30 the linear speed of belt 40 through chamber 31 is ten feet in four minutes. The discharge temperature of the product is 300 degrees Fahrenheit. The temperature of such product may rise to 320 degrees Fahrenheit. on standing twenty minutes because the atmosphere in chamber 31 is a neutral one effectively free from available oxygen for oxidation of the asphaltic components while the atmosphere outside chamber 31 contains oxygen which may react with heated asphaltic concrete. The treated asphaltic concrete particles pass over or under the screen 23 in a few (three to five seconds) and, at the temperature chosen for discharge from chamber 31, are not substantially oxidized, and do not rise three degrees Fahrenheit in such time. The pug mill 84 operates substantially closed from the atmosphere. As the process in apparatus 20 uses a steady rate of feed and there is a steady rate of flow of material at a constant linear belt speed, the absolute value of flame temperature at burners 55 and 56 is not critical as the belt speed may be varied for temperatures of 125–150 degrees Centigrade of discharge 158 so as to maintain the final friable and particulate and oxidizable characteristics of the particulate agglomerate discharge product from chamber 31.

The combustion gas temperature may be 200° C. (392° F.) but the temperature of the asphalt must be kept below 20° C. to avoid carbonizing.

Some particulars of the process and system above described follow inasmuch as such details herebelow given are exemplary rather than limiting or critical and comprise in large part information known to those of usual skill in the art to which this invention pertains.

The drum mixer and pug mill are steam jacketed and the laydown machine can be a standard Barber Greene machine, (described at pages 268–269 and FIG. 103, at pages 277–883, FIGS. 115–118, pages 287–291, FIG. 125 of Asphalt Paving Technology 1974, Volume 43A Proceeding of Asphalt Paving Technologits) and side forms can be used to support such laydown machine. The mining of the asphalt concrete can produce slabs of three inches thickness although one and one-half inch is used in the particular model shown.

In the brittle weathered asphalt concrete of the asphaltic concrete mixture in slabs as 70–76 from a weathered zone shown as 60 and 61 in FIG. 8, the asphalt extractable from slabs as 70–76 by the Abson method (ASTM Proceedings, Volume 33, part II, page 704) is found to have a penetration of about 15 or less at 77 degrees F. by ASTM standards part III, pages 220–221, method D5-25/using the 100 gram weight for five seconds. The additive 83 is added so that the asphalt in the finished road as 68 in FIG. 9 has a penetration at 77 degrees F. preferably of 70 and a range of 30–300; while the amount of additive varies dependent on the condition of the asphalt treated, 0.2% to 4.0% of weight of the feed is the range used as additive weight.

In the system 25 for treating the weathered asphalt composition of slabs as 70–76, which asphalt composition contains asphaltenes and components chosen from the group consisting of nitrogen bases, first acidaffins, second acidaffins and paraffins, said asphalts having a ratio $(N+A_1)/(P+A_2)$ equal to Ra, where N, $A_1$, $A_2$, and P are respectively the weight percent of the nitrogen bases, first acidaffins, second acidaffins, and paraffins present in the asphalt to be treated, the additive 83 may comprise an aqueous emulsion of a petroleum oil substantially free of fractions boiling below about 160° C. at 10 millimeters of mercury absolute pressure, substantially free of asphaltenes and containing components chosen from the group consisting of nitrogen bases, first acidaffins and second acidaffins and paraffins and having a ratio $R_0$ equal to about from 0.01 to less than about 19 where $R_0$ is equal to $N'+A'_1/P'+A'_2$ where $N'$, $A'_1$, $A'_2$ and $P'$ are respectively the weight percent of the nitrogen bases, first acidaffins, second acidaffins and paraffins present in said petroleum oil, said asphalt and said oil being employed in the ratio (Z) of the weight of oil to the weight of asphalt to form a treated asphalt of ratio R equal to $$N''+A''_1/P''+A_2$$

where $N''$, $A''_1$, $A''_2$ and $P''$ are each respectively the weight percent of the nitrogen bases, first acidaffins, second acidaffins and paraffins in said treated asphalt where $P''$ is less than about 40%, said asphalt of ratio $R_a$ and said oil being employed in the ratio Z, where $$Z = \frac{(P + A_2)(R_a - R)}{(P' + A_2')(R - R_0)}$$

where R is a value in the range from about 0.4 to about 10; and where $R_a$ is less than 0.4, R is larger than $R_a$; and where $R_a$ is more than about 10, R is less than about 10 and less than $R_a$. Additionally, the oil may have an initial boiling point at 10 millimeters mercury absolute pressure of above about 160° C., and is substantially free of fractions boiling below about 200° C. Also, P' may be from about 5% to about 95% and the value of Z is not greater than that sufficient to produce an asphalt of penetration of not more than about 300. R preferably has a value in the range of about 0.4 to about 1.5 and P' is preferably about 5% to about 95% (while the value of Z is not greater than that sufficient to produce an asphalt having a penetration of not more than about 300) and as described in U.S. Pat. No. 3,162,101 issued Dec. 22, 1964 to F. S. Rostler.

Alternatively the treating composition 83 may be a highly aromatic petroleum extract oil having a viscosity between about 70 and about 8000 SSU at 100° F., a viscosity-gravity constant greater than about 0.90, and a flash point above about 300° F., and consisting essentially of aromatic-type hydrocarbons substantially free from ashaltenes, olefines, and cracked hydrocarbons, said extract having been prepared by a process involving contacting a straight run fraction from an aromatic hydrocarbon-containing crude petroleum with a liquid solvent selective in its action toward aromatic hydrocarbons so as to physically dissolve therein the desired aromatic hydrocarbons without dissolving the undesired non-aromatic hydrocarbons and as described in U.S. Pat. No. 2,639,651 issued May 26, 1953 to Frederick S. Scott.

Pug mill 84 is a conventional road mixer which is a self propelled unit including rotating drums mounted in tandem on which are placed staggered spades alternately angled to provide maximum mixing is fed the resulting mixture (as in U.S. Pat. No. 2,701,213).

The mixer 84 is provided with a series of spray nozzles through which the additive (or rejuvenating composition or conditioner) 83 is fed from its supply container in a fine spray while the mixer is in operation. As the conditioner is added simultaneously with the mixing the motion of the asphaltic particles assures an even distribution of the conditioner throughout the mix.

The blend of bituminous flux oil and powdered asphalt may be shipped and stored without setting up and the addition of small amounts of water provides for avoiding rapid set-up. The amount of water added accordingly depends upon the size of the job and the time factor of delay involved, the amount of added water being somewhat less than one percent of the dry weight of the entire batch. The mixing is continued for about 15 to 90 seconds so as to distribute the water evenly throughout the mix. The mixing of the batch having been completed the batch is discharged from the mixer.

The paving composition after having been so prepared may be stored in hot storage container 85, because excessive setting up of the flux oil is prevented due to the retarding action of the water which remains in the composition for a long period of time; however when the composition is spread out while still in a thin condition the small amount of added water in the paving composition evaporates and the composition can be rolled, pressed or otherwise consolidated in place to produce a pavement having the advantage of a rapid setting time for the flux oil and powdered asphalt components of the binder.

The amount of water added depends on the storage quality desired and upon the nature of the aggregate that is employed. Accordingly the ductility of the amalgamated blend of flux oil and having a penetration as measured by the test for penetration of Bituminous Materials ASTM Designation D5-52 of 70 at 77 degrees F. being at least 30 centimeters at 77 degrees F. and the amount of water is from 0.5 to about 3.5 percent by weight. Alkylating agents as set out in U.S. Pat. No. 2,970,099 may also be used.

The roof 38 of the apparatus 30 is 8 feet long and 18 inches wide (inclusive of walls 32 and 33 attached thereto) and 2 inches thick. The side walls 32 and 33 are 8 feet long and 12 inches high from the top of each of slot edges 122 and 123 to the top of roof 38. The lower shell 28 is 6 inches high from the bottom of its lower panel 119 to the upper edge of its side panels 117 and 118, which upper edges form the location of slots 120 and 121. Panels 117, 118 and 119 and walls 32 and 33 and roof 38 are thermal ceramic insulation and are each 2 inches thick. The furnace or heater apparatus 30 is mounted on a trailer for portability and handled by hooks as 195 and 196 on frame 27. All other portions of system 25 are also portable by mounting on wheels or transportation by a trailer: as shown for assembly 20, where wheels as 111, 112, 113, 114 and 115 are shown on each of the units 92, 30, 23, 84 and 95 respectively.

Figure 12:
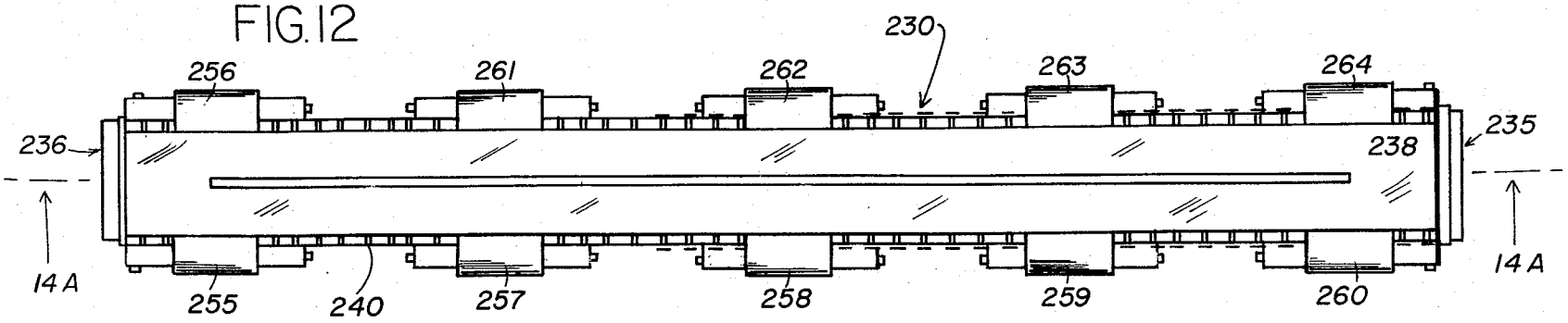
FIG. 12 is a top view of another embodiment of heater apparatus.
Figure 13:
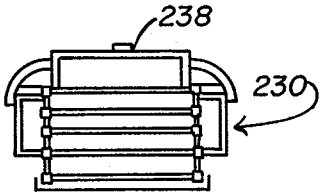
FIG. 13 is an end view along the direction of arrow 13A of FIG. 14.
Figure 14:
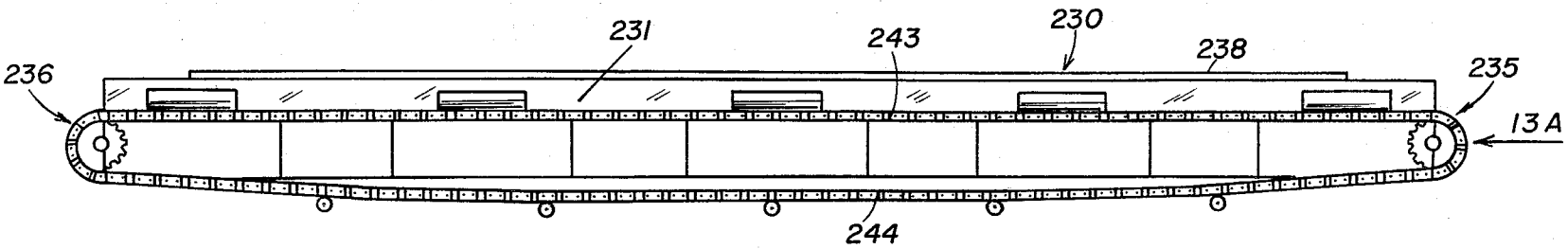
FIG. 14 is a vertical longitudinal sectional view along section 14A—14A of FIG. 12.

The chamber 30 also may be made 30 feet long, 5 feet wide with a 1 foot, 8 inch high shell 29 and a 12 inch high shell 28. A larger plant, as shown in FIGS. 12–14 which is movable from site to site on a trailer has a heater 230 with a chamber 231 60 feet long, a shell 29 5 feet 0 inches wide and 1 foot 6 inches high with manifolds 255–264, each 1 foot 6 inches wide and 1 foot 6 inches high and 8 feet long with 5 feet spacing between adjacent manifolds as shown in FIG. 12, which figure, like FIGS. 13 an 14, is drawn to scale.

The link belts 46 and 47 provide for continuous but non-uniform motion of the drag plates 146 and 147. The drag plates rest on the plate 34 during their traverse of chamber 31 and are uniformly spaced from each other by two links while the belts 46 and 47 are located lateral of the sides of plate 34. As the gear wheels as 41 and 42 have only 8 teeth, together with the speed of the belts the action in apparatus 30 is sufficient to agitate and disrupt the friable mass produced near the discharge end of the path of the feed material in chamber 31 or like chamber in the apparatus 230 where similar link belts and drag plates are used.

I claim:

1. An asphalt pavement recycling system comprising an asphalt treatment apparatus, treatment apparatus feed and product conveyor units, and an asphalt concrete laydown apparatus, said treatment apparatus comprising a bin, a screen oversize conveyor, a heater assembly, a reagent adder, a pug mill, a hot storage bin and treatment apparatus input and discharge conveyors and reserve pile conveyor, said heater apparatus comprising a heater frame, a chamber upper shell, a chamber lower shell, a feed support plate and a conveyor assembly, said frame comprising rigid longitudinally extending frame members, transversely extending members vertically extending frame members firmly joined together and supporting said shells and elements of said conveyor assembly and support plate, said upper shell of the heater assembly comprising a vertical left wall, a vertical right wall and a horizontally extending roof joined together to form a downwardly open U-shaped hood, said horizontal flat rigid plate firmly supported on the frame and near the bottom of said upper shell in a heater chamber within the said heater assembly walls, said conveyor assembly extending from beyond a discharge end of the heater chamber past a feed end thereof to below a feed hopper, said feed hopper operatively near said support plate, said conveyor assembly comprising a front or discharge gear wheel and a feed or rear gear wheel, an upper chain flight and a lower chain flight each carrying drag blades, a motor supported on said frame operating upon a gear to drive the chain flights, a horizontally extending and horizontally elongated space on each side of said heater chamber between the upper heater chamber shell and the lower chamber shell, said space extending vertically above the top of chains and said drag blades are carried above and along and in contact with said support plate in said heater chamber, said treatment apparatus input conveyor feeding into said feeder bin, said bin discharging to and attached to the feed end of said heater apparatus to feed slabs into said treatment apparatus and a heater apparatus discharge screen operatively adjacent a discharge end of the heater apparatus, a pug mill attached to the screen and arranged to receive the undersize of the discharge screen, said pug mill operatively attached to a reagent feeder, a discharge of said pug mill emptying into said hot storage tank, said storage tank discharging by a said discharge conveyor to the treatment assembly product conveyor, said conveyor connected to said laydown apparatus.

2. System as in claim 1, and comprising a tractor, each of said asphalt treatment apparatus, treatment apparatus feed and product conveyor units, and asphalt concrete laydown apparatus having a mobile support.

3. An asphaltic concrete treatment heater apparatus comprising a longitudinally extending heater frame, heater chamber upper shell, heater chamber lower shell, heater chamber feed support plate and a conveyor assembly, said frame comprising rigid longitudinally extending frame members, transversely extending members and vertically extending frame members firmly joined together and supporting said shells and elements of said conveyor assembly and support plate, and chamber heating means, said chamber upper shell comprising a longitudinally and vertically extending left wall, a longitudinally and vertically extending right wall and a horizontally and longitudinally extending roof of thermal insulating material joined together to form a longitudinally extending downwardly open U-shaped hood, said feed support plate having a horizontal flat rigid portion firmly supported on said frame and near the bottom of said upper shell in a heater chamber formed within the said roof and walls, said chamber heating means operatively connected to the interior of said heater chamber, said conveyor assembly extending from beyond a discharge end of said heater chamber past a feed end thereof, said conveyor assembly comprising a discharge end gear wheel and a feed end gear wheel, a pair of upper chain flights and lower chan flights, each upper and lower flight of the pair connected to each other, each flight formed at a series of pivotally joined rigid links and said pair of flights carrying a series of rigid drag blades, means supported on said frame operating upon said gears to drive said chain flights, a horizontally extending and horizontally elongated space on each side of said heater chamber between the upper heater chamber shell and the lower chamber shell, said space extending vertically above the top of said chain flights, and said drag blades are carried above and along and in contact with said support plate in said heater chamber, said drag blades resting on said feed support plates and uniformly longitudinally spaced from each other on said plate, and each drag blade spaced apart from the other by a plurality of links of said chain flights.

4. Apparatus as in claim 3 wherein the heating means comprises a plurality of fuel burners each said burner having a flame axis directed parallel to the length of the roof and walls of said heater chamber.

5. A process of treating weathered embrittled asphalt concrete located in a roadbed portion comprising a mixture of asphaltic concrete by:

(a) first removing embrittled asphaltic concrete from its location on the roadbed in the form of dimensionally stable generally flat slabs of asphaltic concrete, said slabs each 1 to 3 inches thick and 6 to 12 inches wide and 6 to 12 inches long;

(b) passing such slabs onto a support plate within a heater chamber and moving said slabs through such chamber while heating them by directing flames at the walls and roof of said heater chamber whereby said slabs are heated by radiation and in a neutral atmosphere and thereby (c) raising the temperature of the asphaltic concrete until the asphalt component thereof melts and decomposes the initially dimensionally stable slabs into a flowable mass of discrete particulate agglomerates at a temperature below 200° C. and passing hot gasses from said chamber with negligible contact with said mass, each of said particulate agglomerates comprising a mass of aggregate with an asphaltic covering thereon, and then adding asphalt rejuvenating material to said mass, then (d) passing such rejuvenated mixture of asphalt and aggregate to a zone of the roadbed whereat such rejuvenated asphaltic concrete mix is applied.

6. Process as in claim 5 wherein the particulate agglomerates have an average size of less than ¼ inch diameter.

7. Process as in claim 5 wherein the amount of additive varies in range from 0.2 to 0.4% of weight of the slab material fed to the heater chamber.

8. The process of claim 7 wherein the weathered asphalt concrete contains asphaltenes and components chosen from the group consisting of nitrogen bases, first acidaffins, second acidaffins and paraffins, said asphalts having a ratio $(N+A_1)/(P+A_2)$ equal to Ra, where N, $A_1$, $A_2$, and P are respectively the weight percent of the nitrogen bases, first acidaffins, second acidaffins, and paraffins present in the asphalt to be treated and said additive comprises an aqueous emulsion of a petroleum oil substantially free of fractions boiling below about 160° C. at 10 millimeters of mercury absolute pressure, substantially free of asphaltenes and containing components chosen from the group consisting of nitrogen bases, first acidaffins and second acidaffins and paraffins and having a ratio $R_0$ equal to about from 0.01 to less than about 19 where $R_0$ *is equal to* $N'+A'_1/P'+A'_2$ where $N'$, $A'_1$, $A'_2$ and $P'$ are respectively the weight percent of the nitrogen bases, first acidaffins, second acidaffins and paraffins present in said petroleum oil, said asphalt and said oil being employed in the ratio (Z) of the weight of oil to the weight of asphalt to form a treated asphalt of ratio R equal to $$N''+A''_1/P''+A''_2$$

where $N''$, $A''_1$, $A''_2$, and $P''$ are each respectively the weight percent of the nitrogen bases, first acidaffins, second acidaffins and paraffins in said treated asphalt where $P''$ is less than about 40%, said asphalt of ratio $R_a$ and said oil being employed in the ratio Z, where $$Z = \frac{(P + A_2)(R_a - R)}{(P' + A_2')(R - R_0)}$$

where R is a value in the range from about 0.4 to about 10; and where $R_a$ is less than 0.4, R is larger than $R_a$; and where $R_a$ is more than about 10, R is less than about 10 and less than $R_a$.

9. Process as in claim 8 wherein the oil may have an initial boiling point at 10 millimeters mercury absolute pressure of above about 160° C., and is substantially free of fractions boiling below about 200° C. and P' may vary from about 5% to about 95% and the value of Z is not greater than that sufficient to produce an asphalt of penetration of not more than 300.

10. Process as in claim 7 wherein the additive is a highly aromatic petroleum extract oil having a viscosity between about 70 and about 8000 SSU at 100° F., a viscosity-gravity constant greater than about 0.90, and a flash point above about 300° F., and consists essentially of aromatic-type hydrocarbons substantially free from asphalteens, olefines, and cracked hydrocarbons.

11. Process as in claim 5 wherein the rejuvenated asphaltic concrete mix is applied to the roadbed from which removed.

* * * * *